US008752825B2

(12) United States Patent
Watanabe

(10) Patent No.: US 8,752,825 B2
(45) Date of Patent: Jun. 17, 2014

(54) IMAGE FORMING APPARATUS AND SHEET TRANSPORTING APPARATUS WITH COVER AND GUIDE MEMBER PIVOTABLE WITH RESPECT TO APPARATUS BODY

(75) Inventor: Tomonori Watanabe, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 189 days.

(21) Appl. No.: 13/053,806

(22) Filed: Mar. 22, 2011

(65) Prior Publication Data

US 2011/0233859 A1 Sep. 29, 2011

(30) Foreign Application Priority Data

Mar. 23, 2010 (JP) ..... 2010-066696

(51) Int. Cl.
*B65H 31/04* (2006.01)
*B65H 33/16* (2006.01)

(52) U.S. Cl.
CPC ..... *B65H 33/16* (2013.01)
USPC ..... 271/213; 271/186; 399/405; 399/401

(58) Field of Classification Search
USPC ..... 271/213, 186; 399/405, 401
See application file for complete search history.

(56) References Cited

U.S. PATENT DOCUMENTS

| | | | | |
|---|---|---|---|---|
| 6,511,241 | B2 * | 1/2003 | Fetherolf et al. | 271/303 |
| 7,515,849 | B2 * | 4/2009 | Iketani | 399/124 |
| 2002/0039508 | A1 | 4/2002 | Tsusaka et al. | |
| 2006/0159488 | A1 | 7/2006 | Iketani | |

FOREIGN PATENT DOCUMENTS

| | | | |
|---|---|---|---|
| JP | 04-125248 | A | 4/1992 |
| JP | 10-147451 | A | 6/1998 |
| JP | 10288936 | A | * 10/1998 |
| JP | 11-288205 | A | 10/1999 |
| JP | 2002-104707 | | 4/2002 |
| JP | 2002-169441 | A | 6/2002 |
| JP | 2005-141024 | A | 6/2005 |

OTHER PUBLICATIONS

JP Office Action dtd Aug. 21, 2012, JP Appln. 2010-066696, partial English translation.

Notification of First Office Action with Search Report for related Chinese Patent Application No. 201110068118.4, mailed Apr. 27, 2013.

* cited by examiner

*Primary Examiner* — Gerald McClain
(74) *Attorney, Agent, or Firm* — Banner & Witcoff, Ltd.

(57) ABSTRACT

An image forming apparatus includes an apparatus body, an image forming unit, a guide member, and a cover. The guide member is configured to be pivotable with respect to the apparatus body and is configured to guide the sheet along a transporting path. The cover is configured to be pivotable with respect to the apparatus body and is configured to open and close at least a part of the transporting path. The guide member includes a first engaging portion and the cover includes a second engaging portion which engages the first engaging portion of the guide member. One of the guide member and the cover includes an engagement guiding portion which guides one of the first engaging portion and the second engaging portion toward the other one of the first engaging portion and the second engaging portion, such that the first engaging portion and the second engaging portion engages with each other.

18 Claims, 7 Drawing Sheets

IMAGE FORMING APPARATUS AND SHEET TRANSPORTING APPARATUS WITH COVER AND GUIDE MEMBER PIVOTABLE WITH RESPECT TO APPARATUS BODY

CROSS REFERENCE TO RELATED APPLICATION

The present application claims priority from Japanese Patent Application No. 2010-066696, which was filed on Mar. 23, 2010, the disclosure of which is incorporated herein by reference in its entirety.

BACKGROUND

1. Technical Field

The preset invention relates to an image forming apparatus and a sheet transporting apparatus including a cover.

2. Related Art

An image forming apparatus including a rear cover and a guide member is known. In this image forming apparatus, the rear cover and the guide member are engaged with each other such that, when the rear cover is opened and closed (pivoted), the guide member pivots mechanically in conjunction with the opening and closing operation of the rear cover.

Generally, a portion of one of the rear cover and the guide member is necessary to be bent by a user for engaging the rear cover and the guide member each other. There is a risk to become damaged because of the bending operation when the rear cover and the guide member are engaged with each other. Additionally, the process of engaging the rear cover and the guide member each other is relatively laborious.

SUMMARY

A need has arisen to provide an image forming apparatus and a sheet transporting apparatus which may reduce the risk to become damaged and which may include a rear cover and a guide member readily engageable by a user.

According to an embodiment of the present invention, an image forming apparatus includes an apparatus body and an image forming unit configured to form an image on a sheet. The image forming apparatus further includes a guide member and a cover. The guide member is configured to be pivotable with respect to the apparatus body and is configured to guide the sheet ejected from the image forming unit along a transporting path. The cover is configured to be pivotable with respect to the apparatus body and is configured to open and close at least a part of the transporting path. The guide member includes a first engaging portion and the cover includes a second engaging portion which engages the first engaging portion of the guide member. A position of a center of pivotal movement of the cover is spaced apart from a position of a center of pivotal movement of the guide member. One of the guide member and the cover includes an engagement guiding portion which guides one of the first engaging portion and the second engaging portion toward the other one of the first engaging portion and the second engaging portion, such that the first engaging portion and the second engaging portion engages with each other.

According to an embodiment of the present invention, a sheet transporting apparatus includes an apparatus body, a guide member and a cover. The guide member is configured to be pivotable with respect to the apparatus body and is configured to guide a sheet along a transporting path. The cover is configured to be pivotable with respect to the apparatus body and configured to open and close at least a part of the transporting path. The guide member includes a first engaging portion and the cover includes a second engaging portion which engages the first engaging portion of the guide member. A position of a center of pivotal movement of the cover is spaced apart from a position of a center of pivotal movement of the guide member. One of the guide member and the cover includes an engagement guiding portion which guides one of the first engaging portion and the second engaging portion toward the other one of the first engaging portion and the second engaging portion, such that the first engaging portion and the second engaging portion engages with each other.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Embodiments of the invention and their features and advantages may be understood by referring to FIGS. 1-7C, like numerals being used for like corresponding parts in the various drawings.

In embodiments shown below, an image forming apparatus according to the invention is applied to an electrophotographic-type image forming apparatus (for example, laser printer) having a duplex-printing mechanism and the embodiments of the invention will be described in conjunction with drawings below.

First Embodiment

1. General Configuration of Image Forming Apparatus

Figure 1:
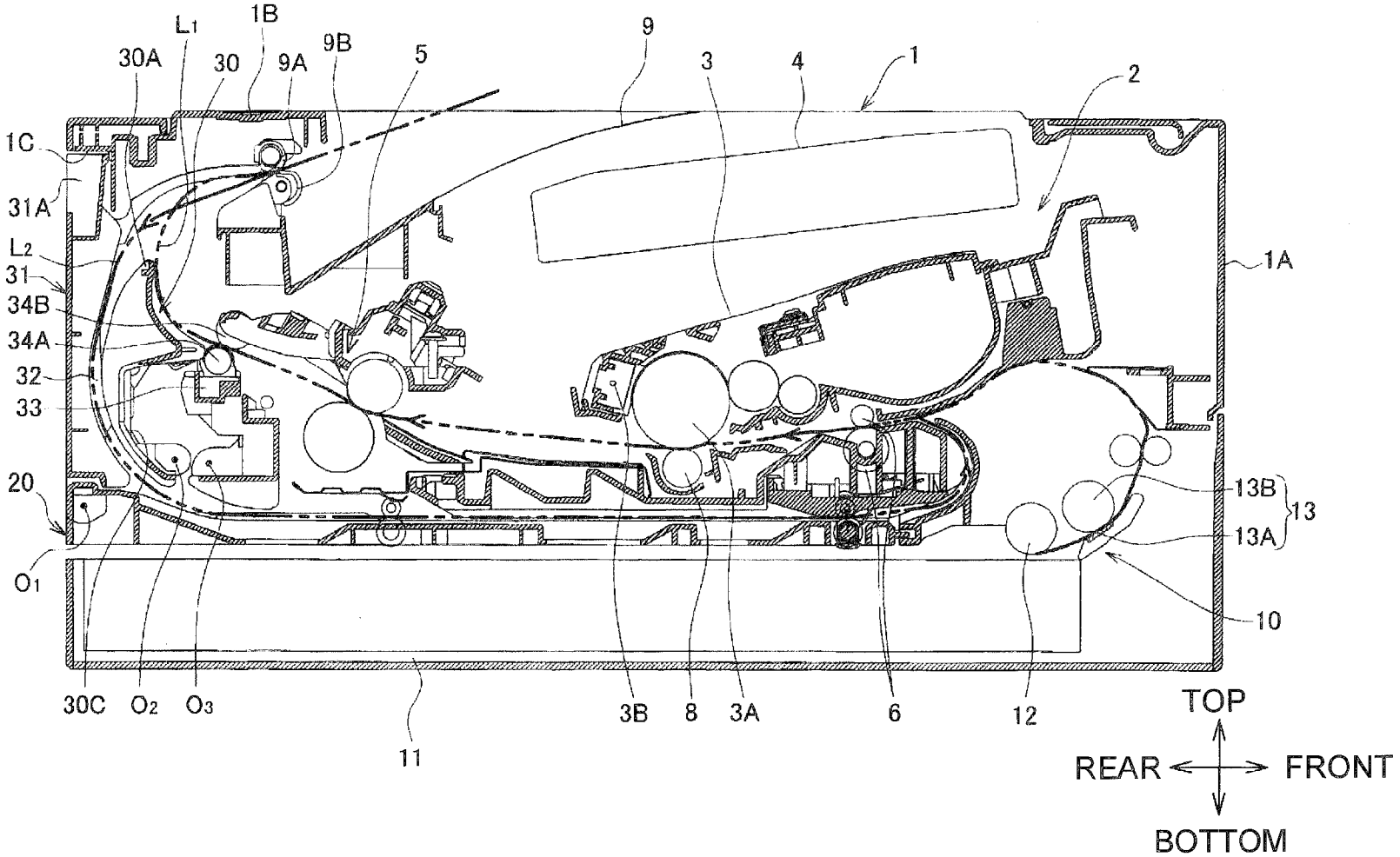
FIG. 1 is a cross-sectional view showing a center cross-section of an image forming apparatus.

An image forming apparatus 1 includes an image forming unit 2, a paper feed device 10, and a retransporting unit (duplex printing unit) 20 as shown in FIG. 1. The image forming unit 2 is an image forming unit configured to form (print) an image on paper or an OHP sheet (hereinafter referred to as "paper"), the paper feed device 10 is a paper feeding unit configured to feed the paper to the image forming unit 2, and the retransporting unit 20 is a retransporting unit for retransporting the paper discharged from the image forming unit 2 toward an inlet port of the image forming unit 2.

The image forming unit 2 according to the first embodiment is configured with an electrophotographic-type image forming unit including a process cartridge 3, an exposing unit 4, and a fixer 5. The process cartridge 3 includes a photosensitive drum 3A configured to carry a developer image, and a charger 3B configured to charge the photosensitive drum 3A stored therein.

Then, the paper transported from the paper feed device 10 toward the image forming unit 2 is transported to a pair of registration rollers 6 and is transported to the photosensitive drum 3A after having corrected in skew by the pair of registration rollers 6.

In contrast, the charged photosensitive drum 3A is exposed by the exposing unit 4. After having formed a static latent image on the outer peripheral surface thereof, the developer (powdered toner in the first embodiment) is supplied to the photosensitive drum 3A, so that the developer image is carried (formed) on the outer peripheral surface of the photosensitive drum 3A.

An electric charge having an opposite polarity from the developer is applied to a transfer roller 8 disposed on the opposite side of the photosensitive drum 3A with respect to the transported paper, and the developer image carried on the photosensitive drum 3A is transferred to the paper by the transfer roller 8.

The fixer 5 fixes the developer transferred to the paper onto the paper by heating the paper after having transferred the developer image. The paper discharged from the fixer 5 and having formed with the image is redirected upward by approximately 180 degrees in direction of transport while being transported on a transporting path L1 (an example of a transporting path) and then is discharged onto a paper discharge tray 9 (an example of face-down tray) provided on the side of an upper end surface of the image forming apparatus 1.

A discharge roller 9A (an example of a switchback roller) is configured to apply a transporting force to the paper by rotating in a state of being in contact with the paper discharged from the fixer 5, and a pinch roller 9B is configured to press the paper against the discharge roller 9A and pinch the paper in conjunction with the discharge roller 9A. The discharge roller 9A is configured to invert the direction of transport of the paper after having subjected to image formation on the front surface thereof and transport the paper toward a retransporting path L2 (an example of a transporting path) at the time of duplex printing which forms images on both the front and back surfaces of the paper.

The paper feed device 10 includes a paper feed tray 11 on which papers to be transported to the image forming unit 2 are placed in the stacked manner, a pickup roller 12 configured to come into contact with the paper positioned at an upper end in the stacking direction from among the papers placed on the paper feed tray 11 and feed the paper toward the image forming section 2, and a separation mechanism 13 including a separation pad 13A and a separation roller 13B.

The paper feed tray 11 is arranged downward of the image forming unit 2 and is detachably mounted on an apparatus body 1A by being inserted thereto. The apparatus body 1A includes a frame (not shown) which constitutes a framework member having the process cartridge 3 or the like assembled thereto and a housing 1B which constitutes an appearance design of the image forming apparatus 1 by covering the frame or the like so as to accommodate the image forming unit 2.

The separation mechanism 13 is a mechanism which separates the plurality of discharged papers into pieces and feeds the separated paper to the image forming unit 2 one by one by applying a transporting resistance to the plurality of papers fed by the pickup roller 12 with the separation pad 13A which comes into contact with the paper on the one side and, simultaneously, applying a transporting force thereto with the separation roller 13B which comes into contact with the paper on the other side.

The retransporting unit 20 constitutes part of the retransporting path L2 which guides the paper inverted by the discharge roller 9A in direction of transport toward an inlet port of the image forming unit 2 (registration rollers 6) and, when performing the duplex printing, the paper having finished the image formation on the front surface thereof is retransported toward the inlet port of the image forming unit 2 via the retransporting path L2.

The retransporting unit 20 is arranged between the paper feed tray 11 and the image forming unit 2, and is detachably inserted and mounted on the apparatus body 1A from the side opposite from the paper feed tray 11.

2. Rear Cover and Outer Shoot

2.1. Structure of Periphery of Rear Cover

As shown in FIG. 1, an outer chute 30 (an example of a guide member) configured to guide the transport of the paper is disposed in part of the transporting path L1 from the fixer 5 to the discharge roller 9A and the outer shoot 30 constitutes part of the transporting path L1 by redirecting the direction of transport of the paper by coming into contact with the paper from the outside of the transporting path L1.

The expression "the outside of the transporting path L1" means the opposite side of the curved transporting path L1 from the center of curvature thereof, and the expression "the inside of the transporting path L1" means the opposite side of the curved transporting path L1 from the outside, that is, the side of the center of curvature.

The housing 1B is provided with an opening 1C (see FIG. 2) for opening the outside of the transporting path L1 on the outside of the outer shoot 30, and the opening 1C is opened and closed by a rear cover 31 (an example of a cover). In the first embodiment, since the part of the transporting path L1 and the part of the retransporting path L2 are overlapped with each other in the vicinity of the discharge roller 9A. Therefore, when the rear cover 31 is opened, the part of the transporting path L1 and the part of the retransporting path L2 are opened.

The rear cover 31 is arranged so as to oppose the outer shoot 30 at a predetermined gap 32 as shown in FIG. 1, and the gap 32 constitutes part of the retransporting path L2. In other word, in the first embodiment, the outer shoot 30 side of the rear cover 31 constitutes a guide portion which guides the transport of the paper by coming into contact with the outside of the paper transported through the retransporting path L2, and the rear cover 31 side of the outer shoot 30 constitutes an inner guide portion of the paper transported through the retransporting path L2.

The rear cover 31 and the outer shoot 30 are assembled so as to be pivotable with respect to the apparatus body 1A (the frame in the first embodiment) (see FIG. 2), and a center of pivotal movement O1 of the rear cover 31 is set on the outside of the retransporting path L2, while a center of pivotal movement O2 of the outer shoot 30 is set on the inside of the retransporting path L2. The centers of pivotal movement O1 and O2 of the rear cover 31 and the outer shoot 30 are spaced apart from each other.

The expression "the outside of the retransporting path L2" means the opposite side of the curved retransporting path L2 from the center of curvature thereof, and the expression "the inside of the retransporting path L2" means the opposite side of the curved retransporting path L2 from the outside, that is, the side of the center of curvature.

In the first embodiment, the centers of pivotal movement O1 and O2 of the rear cover 31 and the outer shoot 30 are set on the lower side of a center position in the height direction of the apparatus body 1A, and the direction of the axial line of the pivotal movement is set to match the direction orthogonal to the thickness direction of the paper to be transported and the direction of transport of the paper (hereinafter referred to as "width direction").

Therefore, the upper ends of the rear cover 31 and the outer shoot 30 make a pivotal movement respectively about lower ends as a center of pivotal movement. Therefore, the upper end of the outer shoot 30, that is, the end on the opposite side from the center of pivotal movement O2 is referred to as a "pivot end 30A" of the outer shoot 30, and the upper end of the rear cover 31, that is, the end on the opposite side from the center of pivotal movement O1 is referred to as a "pivot end 31A" of the rear cover 31.

Pivot shafts 31B and 30B of the rear cover 31 and the outer shoot 30 (see FIG. 3A) are positions displaced from the retransporting path L2 in the width direction, and are provided on both sides of the retransporting path L2 in the width direction.

As shown in FIG. 1, a rear shoot (fixer cover) 33 which guides the paper discharged from the fixer 5 to the outer shoot 30 is provided on the outlet port side of the fixer 5. Therefore, in the first embodiment, the rear shoot 33 and the outer shoot 30 constitute a paper guide portion extending from the outlet port of the fixer 5 to the pivot end 30A substantially continuously.

A transport roller 34A which applies a transporting force to the paper is provided on the rear shoot 33, while a pinch roller 34B configured to be rotated by the movement of the paper in a state of pressing the paper against the transport roller 34A is disposed at a position opposing the transport roller 34A with the intermediary of the transporting path L1.

In the same manner as the outer shoot 30, the rear shoot 33 is also assembled so as to be capable of pivoting with respect to the apparatus body 1A (the frame in the first embodiment) (see FIG. 4), and a center of pivotal movement O3 thereof is set to a position on the rear shoot 33 on the retransporting unit 20 side (the lower side in the first embodiment) with respect to the transport roller 34A, the outside of the transporting path L1 and the inside of the retransporting path L2.

Figure 4:
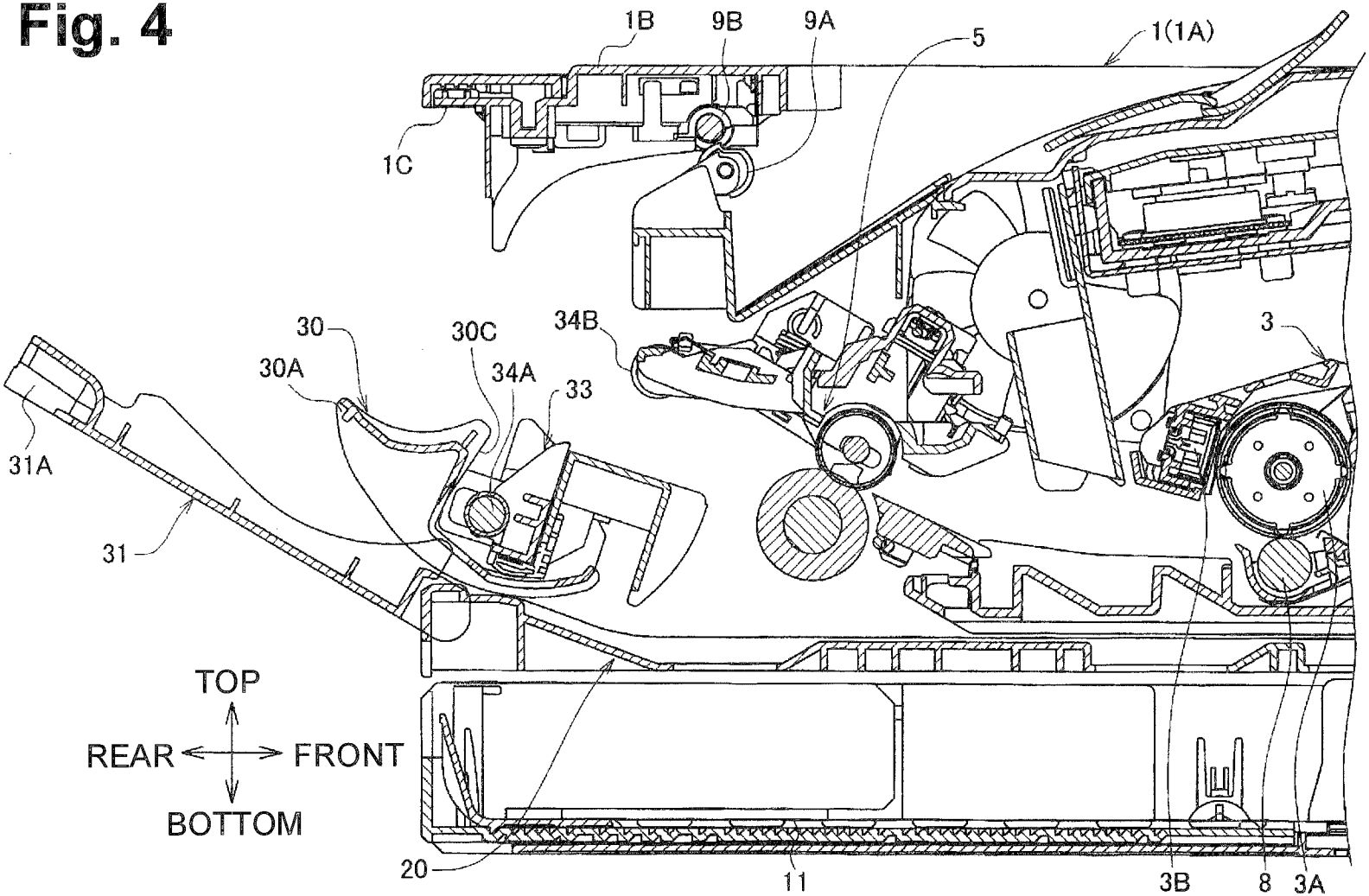
FIG. 4 is a center cross-sectional view showing a state in which the rear cover and a rear shoot are opened in the image forming apparatus.

As shown in FIG. 4, provided on the outer shoot 30 on the side of the center of pivotal movement O3 with respect to the position corresponding to the transport roller 34A is a depressed storage space 30C which allows at least part of the rear shoot 33 to be accommodated therein when the rear shoot 33 is pivoted and displaced toward the outer shoot 30 in a state in which the outer shoot 30 is opened together with the rear cover 31. Therefore, when the rear shoot 33 is accommodated in the storage space 30C, the transport roller 34A assumes a state significantly apart from the pinch roller 34B.

Figures 3A, 3B, 3C:
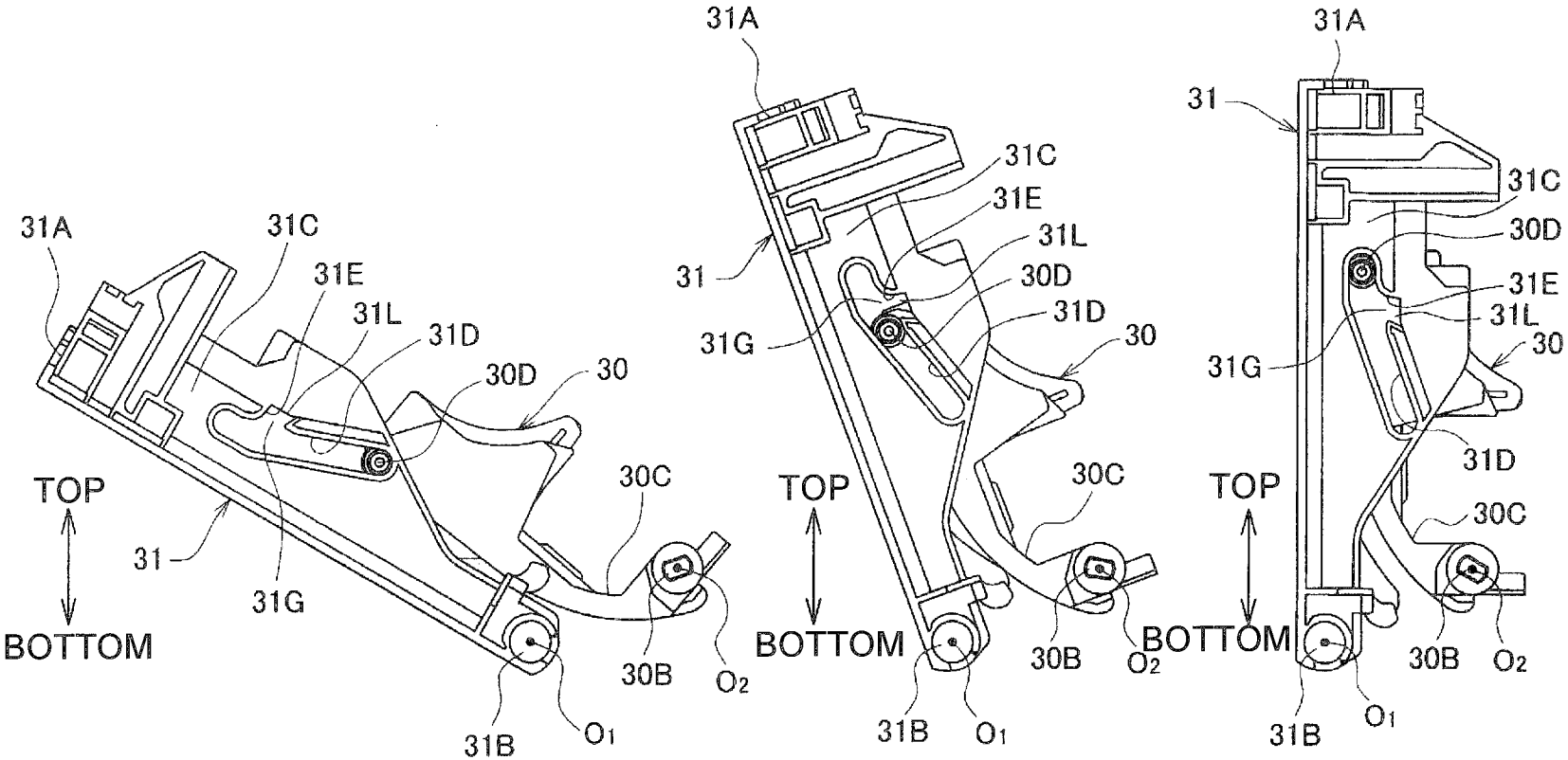
FIGS. 3A to 3C are cross-sectional views of the rear cover and an outer shoot viewed from an end side in the width direction according to a first embodiment of the invention.

As shown in FIGS. 3A to 3C, provided at both end sides of the rear cover 31 in the width direction shifted from the retransporting path L2 are link panels 31C that couple the pivot end 30A side of the outer shoot 30, and the link panels 31C are each provided with a link groove 31D (an example of an elongated hole) in the shape of an elongated hole extending from the side of the pivot end 31A of the rear cover 31 toward the center of pivotal movement O2 of the outer shoot 30.

In contrast, provided on the side of the pivot end 30A and both sides of the outer shoot 30 in the width direction are cylindrical boss portions 30D (an example of a first engaging portion) which project outward in the width direction and are fit to the link grooves 31D (an example of a second engaging portion), and the boss portions 30D are guided by the inner peripheral surfaces of the link grooves 31D and displace along the longitudinal direction of the link grooves 31D mechanically in association with the pivotal (opening and closing) displacement of the rear cover 31. The outward in the width direction means the sides opposite from the retransporting path L2 or the transporting path L1 with the intermediary of the ends of the retransporting path L2 or the transporting path L1 in the width direction.

In other words, in a state in which the rear cover 31 is completely opened, the boss portions 30D are positioned at the ends of the link grooves 31D in the longitudinal direction on the side of the center of pivotal movement O2 as shown in FIG. 3A, the boss portions 30D assume a state of being locked to the ends of the link grooves 31D on the side of the center of pivotal movement O2. Therefore, the outer shoot 30 functions as a link member as a whole, the rear cover 31 does not to open more than that, and hence the state of being locked is maintained.

When the rear cover 31 is closed from the state of being completely opened, the boss portions 30D move in the link grooves 31D toward the pivot end 31A in conjunction therewith (see FIG. 3B). When the rear cover 31 assumes the completely closed state, the boss portions 30D are positioned on the side of the pivot end 31A of the link grooves 31D as shown in FIG. 3C.

In contrast, when the rear cover 31 is opened, the boss portions 30D are displaced in the link grooves 31D in the order reverse from the description given above, that is, in the order of FIG. 3C, FIG. 3B, and FIG. 3A. In other words, in the first embodiment, the pivot end 30A side of the outer shoot 30, that is, the boss portions 30D are coupled to the rear cover 31 so as to be capable of being displaced in the direction toward and away from the center of pivotal movement O1 of the rear cover 31.

Provided on the link panels 31C at portions between portions where the boss portions 30D are positioned when the rear cover 31 is opened (see FIG. 3A) and portions where the boss portions 30D are positioned when the rear cover 31 is closed (see FIG. 3C) are groove portions 31E which communicate with the link grooves 31D.

The groove portions 31E each have a groove shape which allows passage of the boss portion 30D, and have a notch shape extending in the direction substantially parallel to the direction of pivotal movement of the outer shoot 30 (the circumferential direction about the center of pivotal movement O2), being opened at one end thereof, and communicating at the other end with the link groove 31D. The one end of the each groove portion 31E is referred to as an opening end 31L and the other end thereof is referred to as a communication end 31G, hereinafter.

Figure 5A:
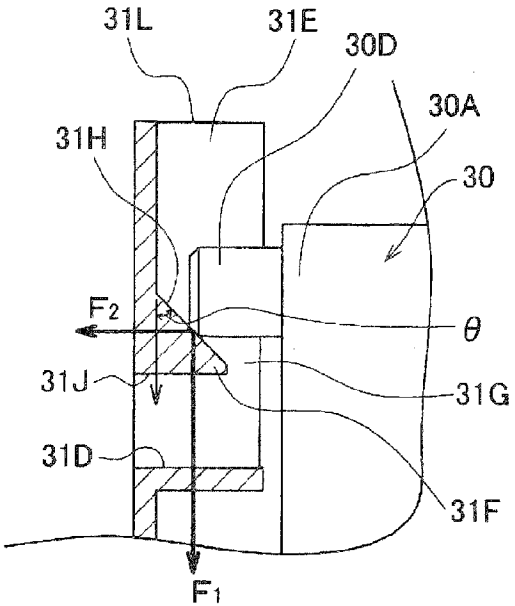
FIG. 5 A to 5C are drawings showing a state of an outer stopper and a boss portion according to the first embodiment of the invention.
Figure 5B:
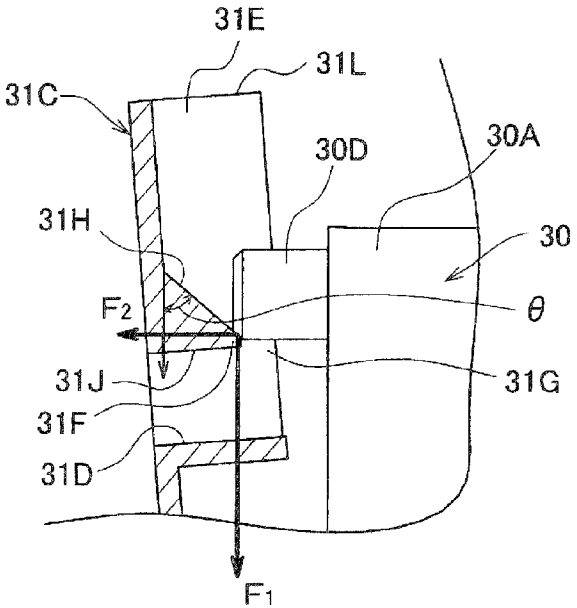
Figure 5C:
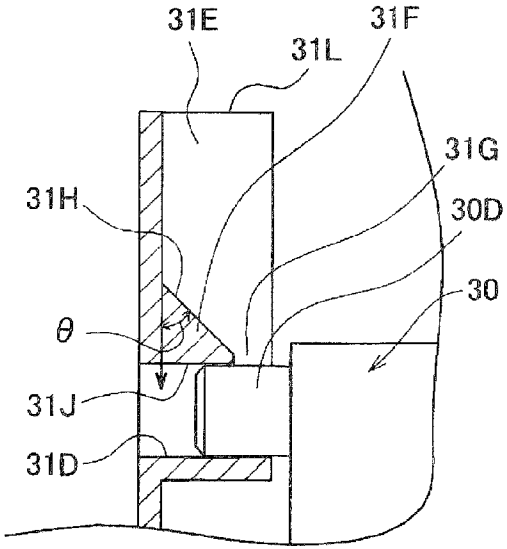

In the first embodiment, as shown in FIGS. 5A to 5C, the link groove 31D is formed into an elongated hole penetrating through link panel 31C in the direction of projection of the boss portion 30D, while the groove portion 31E is formed into a groove shape closed on the outside in the width direction and is opened on the inside in the width direction (the retransporting path L2 side).

The link panel 31C includes an outer stopper 31F (an example of a stopper) formed of resin integrally therewith so as to close the groove portion 31E at least partly to prevent the boss portion 30D from coming apart from the link grooves 31D. The outer stopper 31F is elastically displaced so as to open the groove portion 31E by coming into contact with the boss portion 30D when the boss portion 30D moves in the groove portion 31E from the opening end 31L side to the communication end 31G side.

In other words, provided on a portion of the outer stopper 31F where the boss portion 30D comes into contact with when the boss portion 30D moves in the groove portion 31E from the side of the opening end 31L toward the communication end 31G, that is, when the boss portion 30D moves downward from above in FIG. 5A is an inclined surface 31H inclined at an angle θ smaller than 90 degrees with respect to the direction from the side of the opening end 31L toward the communication end 31G.

Therefore, the inclined surface 31H is inclined with respect to the direction from the side of the opening end 31L toward the communication end 31G so as to be closer to a root of the boss portion 30D (inward in the width direction in FIG. 5A) as it goes from the side of the opening end 31L toward the communication end 31G.

In contrast, provided on the outer stopper 31F on the opposite side from the inclined surface 31H, that is, on the side of the communication end 31G (the lower side in FIG. 5A) is a locked surface 31J inclined in parallel to the direction of projection of the boss portion 30D or in the opposite direction from the inclined surface 31H.

Therefore, in the state in which the boss portion 30D is inserted into the link grooves 31D, as shown in FIG. 5C, the boss portion 30D is locked to the locked surface 31J, so that the boss portion 30D is prevented from coming apart from the link grooves 31D.

2.2. Assembly of Boss Portion To Link Mechanism

Figure 6C:
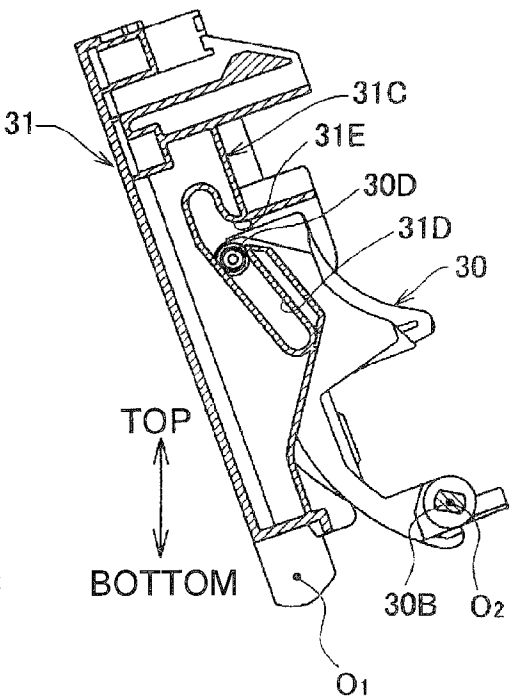
FIGS. 6A to 6C are drawings showing an assembly of the rear cover and the outer shoot (the boss portion) according to the first embodiment of the invention.
Figure 6B:
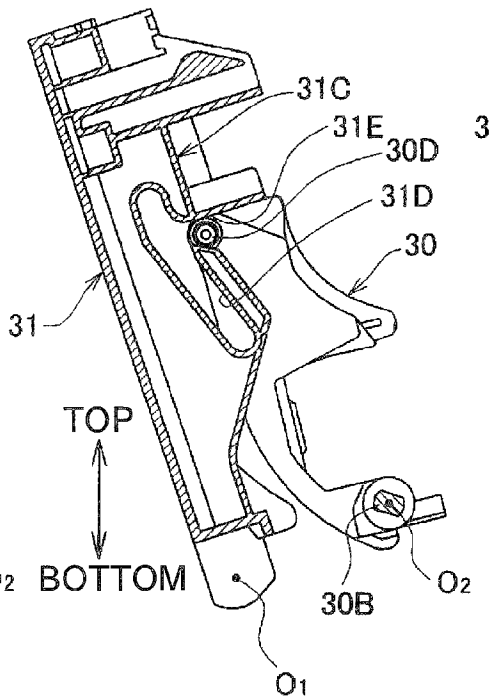
Figure 6A:
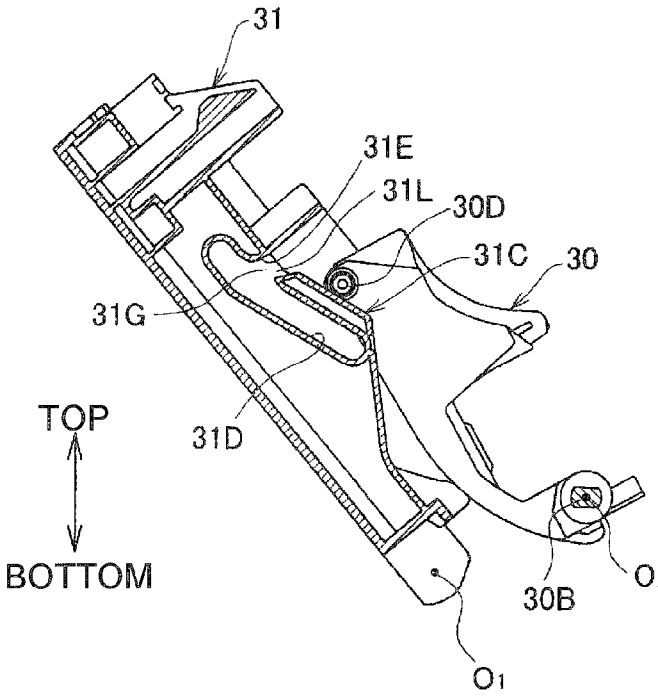

In the first embodiment, as shown in FIGS. 6A to 6C, when the outer shoot 30 is pressed against the rear cover 31 while moving the rear cover 31 from the opened state to the closed state in a state in which the rear cover 31 and the outer shoot 30 are assembled to the apparatus body 1A, the assembly of the boss portion 30D to the link groove 31D is completed.

In other words, when the rear cover 31 is opened in a state in which the rear cover 31 and the outer shoot 30 are assembled to the apparatus body 1A, the boss portion 30D assumes a state of being ran on an upper end portion of the link panel 31C due to a gravitational force applied to the outer shoot 30 as shown in FIG. 6A.

Then, when the rear cover 31 is closed in a state in which the boss portion 30D is ran on the upper end portion of the link panel 31C, the boss portion 30D moves on the upper end portion of the link panel 31C toward the opening end 31L and, simultaneously, the outer shoot 30 is pivotally displaced in the closing direction. When the boss portion 30D reaches the opening end 31L, the boss portion 30D is fitted into the groove portion 31E as if the boss portion 30D drops from the opening end 31L to the communication end 31G as shown in FIG. 6B.

At this time, when the boss portion 30D is fitted to the groove portion 31E, first of all, the boss portion 30D comes into contact with the inclined surface 31H as shown in FIG. 5A. When the outer shoot 30 is pressed from this state toward the rear cover 31, a force to assemble the boss portion 30D to the link groove 31D (hereinafter, referred to as an assembling force F1) is generated, so that a force F2 (hereinafter, referred to as a displacing force F2) in the direction (the width direction orthogonal to the direction of the assembling force F1 in the first embodiment) intersecting the direction of the assembling force F1 is applied to the inclined surface 31H (the outer stopper 31F).

Therefore, since the link panel 31C including the outer stopper 31F provided on both end sides in the width direction is elastically displaced entirely in the direction of the displacing force F2 so as to move away from each other as shown in FIG. 5B. Therefore, as shown in FIG. 5C, the boss portion 30D is fitted into the link groove 31D, whereby assembly of the boss portion 30D to the link groove 31D is completed (see FIG. 6C).

After having completed the assembly, the elastically deformed outer stopper 31F automatically restores to its original position and hence the groove portion 31E is closed by the outer stopper 31F at least partly. Accordingly, the boss portion 30D is prevented from coming apart from the link groove 31D.

3. Characteristics of Image Forming Apparatus (Specifically, Assembly of Boss Portions to Link Grooves) According to First Embodiment In the first embodiment, since the each link panel 31C is provided with the groove portion 31E having a groove shape which allows passage of the boss portion 30D, being opened at one end side and communicating at the other end side with the link groove 31D, the boss portion 30D can be fitted from the groove portion 31E to the link groove 31D without causing the link panel 31C to be subjected to a significant flexural deformation, so that the boss portion 30D can be fitted easily into the link groove 31D.

Therefore, according to the first embodiment, damage of the link panel 31C caused by bending of the link panel 31C more than necessary rarely occurs and the step of bending the link panel 31C is not necessary, so that the reduction of the number of assembly steps (time) is achieved.

When the rear cover 31 is closed in a state in which the boss portion 30D is not assembled to the link groove 31D, that is, in a state in which the boss portion 30D is out of the link groove 31D, the outer shoot 30 is pressed against another member such as the rear shoot 33 by the force to close the rear cover 31.

Therefore, a reaction force from another member acts on the outer shoot 30, and the reaction force is a force in the direction to press the outer shoot 30 against the rear cover 31. Therefore, the reaction force exerts the same action as the assembling force F1 on the outer shoot 30.

Therefore, in the first embodiment, by bringing the rear cover 31 from the opened state to the closed state in a state in which the rear cover 31 and the outer shoot 30 are assembled to the apparatus body 1A, the boss portion 30D is assembled to the link groove 31D automatically without the necessity of specific operation of the outer shoot 30.

The first embodiment is characterized in that the outer stopper 31F so as to close the groove portion 31E at least partly to prevent the boss portion 30D from coming apart from the link groove 31D is provided, and the outer stopper 31F is elastically displaced so as to open the groove portion 31E by coming into contact with the boss portion 30D when the boss portion 30D moves in the groove portion 31E from the opening end 31L side to the communication end 31G side.

Accordingly, in the first embodiment, the boss portion 30D can be assembled (fitted) easily by causing the outer stopper 31F to be displaced elastically by a force to assemble the boss portion 30D to the link groove 31D, that is, by the assembling force F1, and after having completed the assembly, since the elastically displaced outer stopper 31F is automatically restored to its original position and the groove portion 31E is closed at least partly, the boss portion 30D is prevented from coming apart from the link groove 31D.

The first embodiment is also characterized in that the link panel 31C provided with the outer stopper 31F is formed of resin, and the outer stopper 31F is provided with the inclined surface 31H which comes into contact with the boss portion 30D when the boss portion 30D moves in the groove portion 31E from the side of the opening end 31L toward the communication end 31G and is inclined at an angle smaller than 90 degrees with respect to the direction from the side of the opening end 31L toward the communication end 31G.

Therefore, according to the first embodiment, when the assembling force F1 acts on the inclined surface 31H, the outer stopper 31F is elastically displaced in the direction intersecting the direction of the assembling force F1 (the direction of the force F2 in the first embodiment) as shown in FIG. 5B, the boss portion 30D can be assembled (fitted) easily.

At this time, when the boss portion 30D is in contact with the inclined surface 31H, the force which elastically displaces the outer stopper 31F, that is, the displacing force F2 acts on the outer stopper 31F, while when the boss portion 30D is not in contact with the inclined surface 31H, the displacing force F2 does not act on the outer stopper 31F. Therefore, the entire rear cover 31 including the link panel 31C is not bent more than necessary, so that the damage of the link panel 31C or the rear cover 31 is prevented.

The first embodiment is characterized in that the boss portion 30D is displaced in the link groove 31D along the longitudinal direction in mechanically conjunction with the opening and closing operation of the rear cover 31 and, the groove portion 31E is in communication with the link groove 31D at a portion between a portion where the boss portion 30D is positioned when the rear cover 31 is opened and a portion where the boss portion 30D is positioned when the rear cover 31 is closed.

Incidentally, when the image forming apparatus 1 is in operation, the rear cover 31 assumes the opened state or the closed state, and does not assume an intermediate state between these two states.

Therefore, as in the first embodiment, if the groove portion 31E is in communication with the link groove 31D at a portion between the portion where the boss portion 30D is positioned when the rear cover 31 is opened and the portion where the boss portion 30D is positioned when the rear cover 31 is closed, the boss portion 30D is prevented from coming apart from the link groove 31D at least when the image forming apparatus 1 is in operation.

According to the first embodiment, when the rear shoot 33 is accommodated in the storage space 30C, the transport roller 34A assumes a state significantly apart from the pinch roller 34B, so that the paper jammed in the transporting path L1 can easily be removed.

Figure 2:
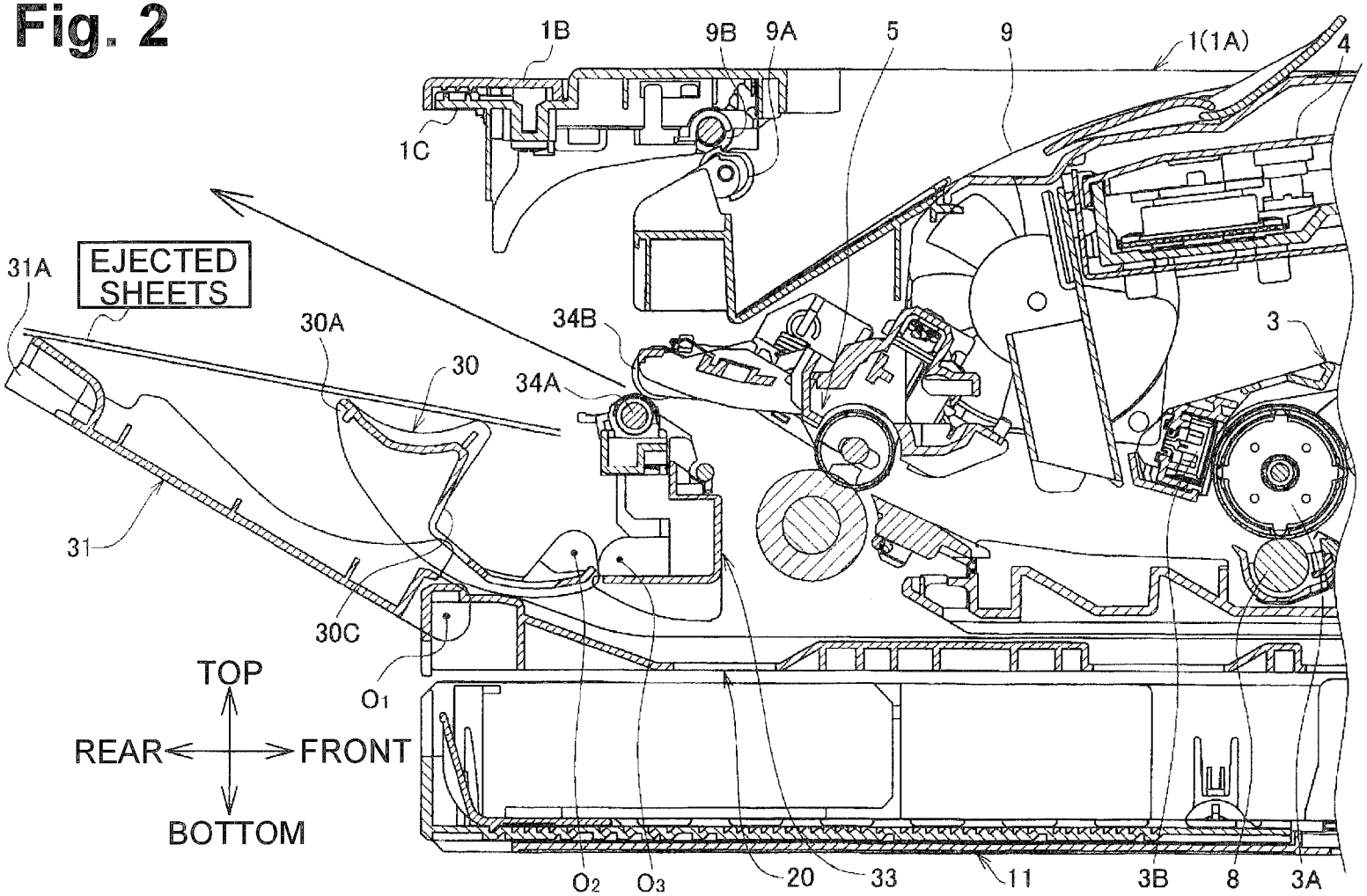
FIG. 2 is a center cross-sectional view showing a state in which a rear cover is opened in the image forming apparatus.

According to the first embodiment, when the rear cover 31 is opened, the outer shoot 30 also pivots to open in conjunction therewith. Therefore, as shown in FIG. 2, the paper discharged from the fixer 5 can be discharged linearly toward the rear of the image forming apparatus 1 without being discharged toward the paper discharge tray 9.

At this time, the paper discharged linearly toward the rear of the image forming apparatus 1 is received by the pivot end 31A side of the rear cover 31 and the outer shoot 30. However, since the center of pivotal movement O2 of the outer shoot 30 and the center of pivotal movement O3 of the rear shoot 33 are close to each other, and the lower side of the outer shoot 30 and the lower side of the rear shoot 33 are close to each other without forming a gap therebetween, a problem such that a trailing end of the discharged paper in the discharging direction drops from the gap between the outer shoot 30 and the rear shoot 33 toward the retransporting unit 20 does not occur.

4. Relationship Between the Specific Matters of the Invention and the First Embodiment In the first embodiment, the outer shoot 30 corresponds to a guide member described in Claims, the rear cover 31 corresponds to a cover described in Claims, and the link groove 31D corresponds to an elongated hole.

Second Embodiment

Figure 7A:
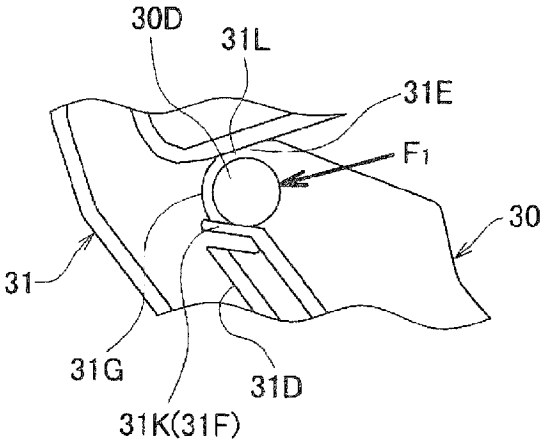
FIGS. 7A to 7C are drawings showing an assembly of the rear cover and the outer shoot (the boss portion) according to a second embodiment of the invention.
Figure 7B:
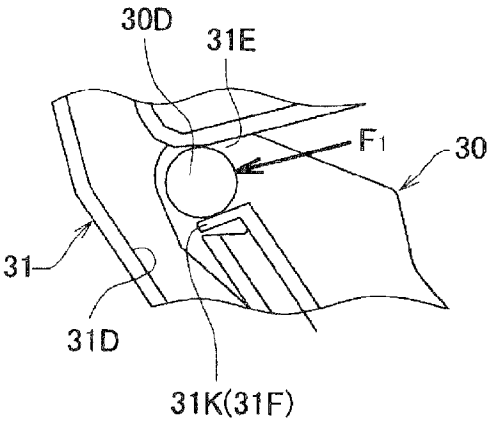
Figure 7C:
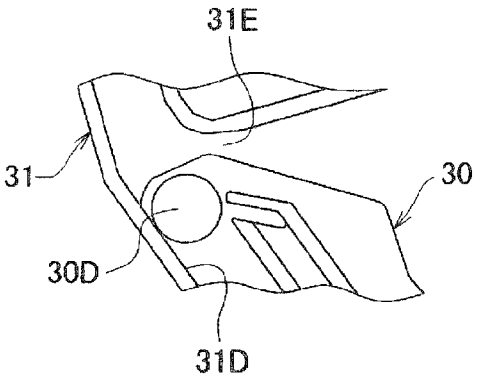

In a second embodiment, the outer stopper 31F is configured of a resin-made spring portion 31K (an example of spring portion and an example of a stopper) which is capable of being elastically displaced from the side of the opening end 31L toward the communication end 31G, that is, in the direction intersecting the direction of the assembling force F1 as shown in FIGS. 7A to 7C.

In other words, the spring portion 31K which constitutes the outer stopper 31F has a leaf spring shape having a fixed end on the opening end 31L side by being integrated with the link panel 31C, and a displaceable free end on the communication end 31G side as shown in FIG. 7A.

Therefore, when the assembling force F1 acts on the boss portion 30D in a state in which the boss portion 30D is fitted into the groove portion 31E, the free end (the communication end 31G) side of the spring portion 31K is elastically displaced in the direction intersecting the direction of the assembling force F1 as shown in FIG. 7B, so that the boss portion 30D is fitted into the link groove 31D, whereby assembly of the boss portion 30D into the link groove 31D is completed (see FIG. 7C).

After having completed the assembly, the elastically deformed spring portion 31K (the outer stopper 31F) automatically restores to their original position and hence the groove portions 31E are closed by the spring portion 31K (the outer stoppers 31F) at least partly. Accordingly, the boss portions 30D are prevented from coming apart from the link grooves 31D.

Other Embodiments

In the embodiments described above, the link groove 31D is provided on the rear cover 31, and the boss portion 30D is provided on the outer shoot 30. Alternatively, the link groove 31D may be provided on the outer shoot 30 and the boss portion 30D may be provided on the rear cover 31.

In the embodiments described above, the link groove 31D is an elongated hole penetrating through the direction of projection of the boss portion 30D and the groove portion 31E has a structure closed on the distal end side in the direction of projection of the boss portion 30D. The link groove 31D and the groove portion 31E may be replaced with rails having a junction and the boss portion 30D may be replaced with a member having a recess for engaging with the rails.

In the embodiments described above, the outer stopper 31F and the periphery thereof are formed of resin so as to be elastically displaceable. However, other material such as thin metal may be applicable. Further, the outer stopper 31F is not essential. The outer stopper 31F may be eliminated so as to disengage the rear cover 31 from the outer shoot 30 intentionally.

The invention must only conform to the scope of the invention described in Claims, and is not limited to the above-described embodiment.

What is claimed is:

1. An image forming apparatus comprising:

an apparatus body;

a sheet feeding unit configured to feed a sheet along a transporting path;

an image forming unit configured to form an image on the sheet;

a guide member configured to be pivotable with respect to the apparatus body and having a shape for guiding the sheet, on which an image is formed by the image forming unit, along the transporting path, the guide member including a first engaging portion; and a cover configured to be pivotable with respect to the apparatus body and configured to open and close at least a part of the transporting path, the cover including a second engaging portion which engages the first engaging portion of the guide member, and a position of a center of pivotal movement of the cover being spaced apart from a position of a center of pivotal movement of the guide member, wherein the cover includes an engagement guiding portion having a shape for guiding the first engaging portion along a first route toward the second engaging portion, such that the first engaging portion and the second engaging portion engage with each other, wherein the first engaging portion and the second engaging portion are configured such that, when the cover pivots from (i) an open or partially closed position to (ii) a fully closed position, the first engaging portion engaged with the second engaging portion moves within the second engaging portion along a second route disposed at an oblique angle with respect to the first route of the first engaging portion.

2. The image forming apparatus according to claim 1, wherein the first engaging portion includes a boss and the second engaging portion has an elongated hole along which the boss is displaceable.

3. The image forming apparatus according to claim 2, wherein the engagement guiding portion includes a groove along which the boss is displaceable.

4. The image forming apparatus according to claim 2, wherein the boss moves along the elongated hole in mechanical conjunction with the opening and closing of the cover.

5. The image forming apparatus according to claim 2, wherein the boss is disposed at a distal end of the guide member.

6. The image forming apparatus according to claim 3, further comprising a stopper configured to prevent the boss from coming apart from the elongated hole toward the groove of the engagement guiding portion and configured to allow the boss to move from the groove to the elongated hole.

7. The image forming apparatus according to claim 6, wherein the stopper is made of resin.

8. The image forming apparatus according to claim 6, wherein the stopper includes an inclined surface facing away from the elongated hole such that the boss is guided on the inclined surface toward the elongated hole.

9. The image forming apparatus according to claim 6, wherein the stopper includes a spring portion which deforms such that the stopper retracts to allow the boss to move toward the elongated hole.

10. The image forming apparatus according to claim 1, wherein the guide member and the cover are configured to receive the sheet in a state that an image-formed surface of the sheet faces up when both the guide member and the cover are opened.

11. The image forming apparatus according to claim 1, further comprising a switchback roller configured to switchback the sheet, on which an image is formed, toward the part of the transporting path.

12. The image forming apparatus according to claim 11, further comprising a face-down tray on which the switchback roller ejects the sheet in a state that an image-formed surface of the sheet faces down.

13. A sheet transporting apparatus comprising:

an apparatus body;

a sheet feeding unit configured to feed a sheet along a transporting path;

a guide member configured to be pivotable with respect to the apparatus body and having a shape for guiding the sheet along the transporting path, the guide member including a first engaging portion; and a cover configured to be pivotable with respect to the apparatus body and configured to open and close at least a part of the transporting path, the cover including a second engaging portion which engages the first engaging portion of the guide member, and a position of a center of pivotal movement of the cover being spaced apart from a position of a center of pivotal movement of the guide member, wherein the cover includes an engagement guiding portion having a shape for guiding the first engaging portion along a first route toward the second engaging portion, such that the first engaging portion and the second engaging portion engages with each other, wherein the first engaging portion and the second engaging portion are configured such that, when the cover pivots from (i) an open or partially closed position to (ii) a fully closed position, the first engaging portion engaged with the second engaging portion moves within the second engaging portion along a second route disposed at an oblique angle with respect to the first route of the first engaging portion.

14. The sheet transporting apparatus according to claim 13, wherein the first engaging portion includes a boss and the second engaging portion has an elongated hole along which the boss is displaceable.

15. The sheet transporting apparatus according to claim 14, wherein the engagement guiding portion includes a groove along which the boss is displaceable.

16. The sheet transporting apparatus according to claim 15, further comprising a stopper configured to prevent the boss from coming apart from the elongated hole toward the groove of the engagement guiding portion and configured to allow the boss to move from the groove to the elongated hole.

17. The sheet transporting apparatus according to claim 16, wherein the stopper includes a spring portion which deforms such that the stopper retracts to allow the boss to move toward the elongated hole.

18. The sheet transporting apparatus according to claim 16, wherein the stopper includes an inclined surface facing away from the elongated hole such that the boss is guided on the inclined surface toward the elongated hole.

* * * * *

UNITED STATES PATENT AND TRADEMARK OFFICE

CERTIFICATE OF CORRECTION

PATENT NO. : 8,752,825 B2
APPLICATION NO. : 13/053806
DATED : June 17, 2014
INVENTOR(S) : Tomonori Watanabe It is certified that error appears in the above-identified patent and that said Letters Patent is hereby corrected as shown below:

On the title page:

Item (54) and in the specification, Column 1, Line 1, Title, Please delete
"IMAGE FORMING APPARATUS AND SHEET TRANSPORTING APPARATUS WITH COVER AND GUIDE MEMBER PIVOTABLE WITH RESPECT TO APPARATUS BODY"
and replace with --IMAGE FORMING AND SHEET TRANSPORTING APPARATUS WITH COVER AND GUIDE MEMBER PIVOTABLE WITH RESPECT TO APPARATUS BODY--

Item (75), under Inventor:
Please delete "Ichinomiya (JP)" and insert --Ichinomiya-shi, (JP)--

Signed and Sealed this
Twenty-fourth Day of May, 2016

Michelle K. Lee

Michelle K. Lee
*Director of the United States Patent and Trademark Office*